US010845003B2

(12) United States Patent
Tsuji

(10) Patent No.: US 10,845,003 B2
(45) Date of Patent: Nov. 24, 2020

(54) CRYOGENIC LIQUID TANK

(71) Applicant: IHI Corporation, Tokyo (JP)

(72) Inventor: Chikahide Tsuji, Tokyo (JP)

(73) Assignee: IHI PLANT SERVICES CORPORATION, Tokyo (JP)

( * ) Notice: Subject to any disclaimer, the term of this patent is extended or adjusted under 35 U.S.C. 154(b) by 259 days.

(21) Appl. No.: 16/078,834

(22) PCT Filed: Feb. 22, 2017

(86) PCT No.: PCT/JP2017/006535
§ 371 (c)(1),
(2) Date: Aug. 22, 2018

(87) PCT Pub. No.: WO2017/146086
PCT Pub. Date: Aug. 31, 2017

(65) Prior Publication Data

US 2019/0056062 A1 Feb. 21, 2019

(30) Foreign Application Priority Data

Feb. 24, 2016 (JP) ..... 2016-033469

(51) Int. Cl.
*F17C 1/02* (2006.01)
*F17C 13/08* (2006.01)
(Continued)

(52) U.S. Cl.
CPC ..... *F17C 1/02* (2013.01); *E04H 7/18* (2013.01); *F17C 3/022* (2013.01); *F17C 13/001* (2013.01);
(Continued)

(58) Field of Classification Search
CPC ..... F17C 1/02; F17C 1/12; F17C 3/04; F17C 13/001; F17C 13/10; E04H 7/00
(Continued)

(56) References Cited

U.S. PATENT DOCUMENTS 3,860,140 A 1/1975 Wichman et al.
10,480,714 B2 * 11/2019 Sugiura ..... F17C 3/022
(Continued)

FOREIGN PATENT DOCUMENTS

CA 2 903 385 A1 10/2014
CN 105074319 A 11/2015
(Continued)

OTHER PUBLICATIONS

International Search Report and Written Opinion dated May 9, 2017 in PCT/JP2017/006535 (8 pages).

*Primary Examiner* — Anthony D Stashick
*Assistant Examiner* — Raven Collins
(74) *Attorney, Agent, or Firm* — Rockwell, Figg, Ernst & Manbeck, P.C.

(57) ABSTRACT

A cryogenic liquid tank (1) includes a reservoir (5) that includes a bottom portion (5*a*, 5*a*1, or 5*a*2) and a side wall (5*b*), a support portion (4) that supports the reservoir (5), and an intermediate member (10) that is provided between the reservoir (5) and the support portion (4). The support portion (4) includes an outer support portion (4*b*) which supports the side wall (5*b*), and an inner support portion (4*a*) which is disposed to be adjacent to an inner side of the outer support portion (4*b*), includes a heat insulating layer formed of an elastic material, and supports the bottom portion (5*a*, 5*a*1, or 5*a*2) of the reservoir (5). A cover portion (9*a*, 9*a*1, or 15) covering a boundary between the outer support portion (4*b*) and the inner support portion (4*a*) is provided between the support portion (4) and the intermediate member (10).

2 Claims, 3 Drawing Sheets

(51) Int. Cl.

| | |
|---|---|
| ***F17C 3/02*** | (2006.01) |
| ***E04H 7/18*** | (2006.01) |
| ***E04H 7/06*** | (2006.01) |
| ***F17C 13/00*** | (2006.01) |

(52) U.S. Cl.
CPC ..... *F17C 13/08* (2013.01); *F17C 13/081* (2013.01); *E04H 7/06* (2013.01); *F17C 2201/0109* (2013.01); *F17C 2201/0119* (2013.01); *F17C 2201/032* (2013.01); *F17C 2201/052* (2013.01); *F17C 2203/011* (2013.01); *F17C 2203/0329* (2013.01); *F17C 2203/0333* (2013.01); *F17C 2203/0341* (2013.01); *F17C 2203/0621* (2013.01); *F17C 2203/0629* (2013.01); *F17C 2203/0639* (2013.01); *F17C 2203/0678* (2013.01); *F17C 2205/0126* (2013.01); *F17C 2205/0184* (2013.01); *F17C 2221/033* (2013.01); *F17C 2223/0161* (2013.01); *F17C 2223/033* (2013.01); *F17C 2260/011* (2013.01); *F17C 2270/0136* (2013.01); *F17C 2270/05* (2013.01)

(58) Field of Classification Search
USPC ..... 220/592.2
See application file for complete search history.

(56) References Cited

U.S. PATENT DOCUMENTS

| | | | | |
|---|---|---|---|---|
| 2015/0053692 | A1* | 2/2015 | Uchiyama | F17C 3/04 220/560.1 |
| 2016/0032606 | A1* | 2/2016 | Simmons | E04H 7/18 52/195 |

FOREIGN PATENT DOCUMENTS

| | | | |
|---|---|---|---|
| CN | 105164458 | A | 12/2015 |
| JP | 65-82599 | U | 6/1980 |
| JP | 57-101196 | A | 6/1982 |
| JP | 60-67499 | U | 5/1985 |
| JP | 9-32339 | A | 2/1997 |
| JP | 10-37513 | A | 2/1998 |
| JP | 2000-46299 | A | 2/2000 |
| JP | 2000-346294 | A | 12/2000 |
| WO | 2014/143115 | A1 | 9/2014 |
| WO | 2014/155843 | A1 | 10/2014 |

* cited by examiner

CRYOGENIC LIQUID TANK

CROSS REFERENCE TO RELATED APPLICATIONS

This application is a 35 U.S.C. 371 National Phase Entry Application from PCT/JP2017/006535, filed Feb. 22, 2017, which claims priority to Japanese Patent Application No. 2016-033469, filed Feb. 24, 2016, the disclosures of which are incorporated herein in their entirety by reference, and priority is claimed to each of the foregoing.

TECHNICAL FIELD

The present disclosure relates to a cryogenic liquid tank.

Priority is claimed on Japanese Patent Application No. 2016-33469, filed on Feb. 24, 2016, the content of which is incorporated herein by reference.

BACKGROUND ART

A tank for storing cryogenic liquid (cryogenic liquid tank), such as a liquefied natural gas (LNG) tank, includes a reservoir in which cryogenic liquid is accumulated and a support portion (bottom portion cold reserving layer) which supports the reservoir.

In the related art, pearlite concrete has been used for an outer circumferential portion of a support portion, a heat insulating material has been used for a central portion of the support portion, and an annular plate has been disposed between the outer circumferential portion and a reservoir (for example, refer to PTL 1). In addition, as a heat insulating material, cellular glass known as a non-elastic material, or rigid polyurethane foam known as an elastic material has been used (for example, refer to PTL 2).

CITATION LIST

Patent Literature

[PTL 1] Japanese Unexamined Patent Application, First Publication No. H10-37513

[PTL 2] Japanese Unexamined Utility Model Application Publication No. S60-67499

SUMMARY OF INVENTION

Technical Problem

In an LNG tank in which rigid polyurethane foam is used for a central portion of a support portion, if a liquid pressure is applied to a reservoir while the LNG tank is in operation, there is a possibility that a step part will be generated between pearlite concrete and the rigid polyurethane foam due to the difference between their material characteristics. Otherwise, there is a possibility that rigid polyurethane foam will be gradually precipitated (creep deformation) with time and will generate a step part due to the LNG tank which has been used over a long period of time.

If a step part is generated in this manner, there is a possibility that a concrete member positioned above the step part will be rapidly and locally deformed, a bottom portion of the reservoir positioned on the concrete member will be deformed, and bending stress will be rapidly and locally applied to the bottom portion, so that a significant load will be added to the bottom portion.

The present disclosure has been made in consideration of the foregoing circumstances, and an object thereof is to prevent a significant load from being applied to a bottom portion of a reservoir in a cryogenic liquid tank while being in use.

Solution to Problem

According to a first aspect of the present disclosure, there is provided a cryogenic liquid tank including a reservoir that includes a bottom portion and a side wall, a support portion that supports the reservoir, and an intermediate member that is provided between the reservoir and the support portion. The support portion includes an outer support portion which supports the side wall, and an inner support portion which is disposed to be adjacent to an inner side of the outer support portion, includes a heat insulating layer formed of an elastic material, and supports the bottom portion of the reservoir. A cover portion covering a boundary between the outer support portion and the inner support portion is provided between the support portion and the intermediate member.

Advantageous Effects of Invention

According to the present disclosure, the cover portion covering the boundary between the outer support portion and the inner support portion is provided between the support portion and the intermediate member. Therefore, even in a case where a step part is generated between the outer support portion and the inner support portion, the cover portion restrains the intermediate member from being rapidly and locally deformed, so that the intermediate member is gently deformed in the boundary between the outer support portion and the inner support portion. Consequently, the bottom portion of the reservoir positioned on the intermediate member is prevented from being locally deformed. Accordingly, local bending stress caused by a generated step part can be prevented from being applied to the bottom portion of the reservoir. Therefore, according to the present disclosure, in the cryogenic liquid tank including the support portion that supports the reservoir, it is possible to prevent a significant load from being applied to the bottom portion of the reservoir while being in use.

DESCRIPTION OF EMBODIMENT

Figure 1:
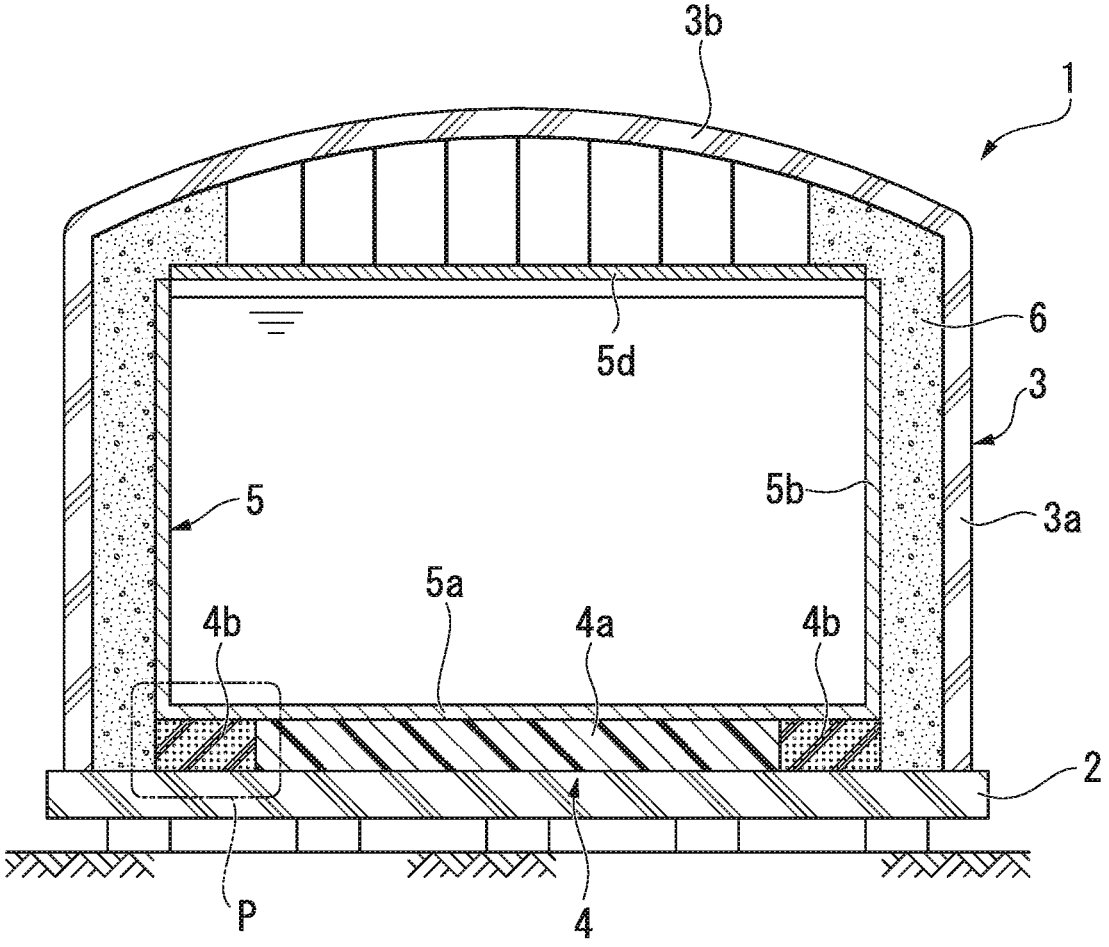
FIG. 1 is a longitudinal sectional view schematically showing an outline configuration of a cryogenic liquid tank according to an embodiment of the present disclosure.

Hereinafter, with reference to the drawings, an embodiment of a cryogenic liquid tank according to the present disclosure will be described. In the drawings described below, in order to depict each of the members in a recognizable size, the scale of each of the members is suitably changed. In addition, the present embodiment will be described with an LNG tank as an example of a cryogenic liquid tank.

In the following description, a "radial direction" denotes a radial direction in a plane shape of the cryogenic liquid tank. A "radially inward direction" denotes a direction toward a middle part from the circumference in a plane shape of the cryogenic liquid tank, and a "radially outward direction" denotes a direction toward the circumference from the middle part in a plane shape of the cryogenic liquid tank.

FIG. 1 is a longitudinal sectional view showing an outline configuration of a ground-type cryogenic liquid tank 1 according to the embodiment of the present disclosure. As shown in FIG. 1, the cryogenic liquid tank 1 according to the present embodiment is a pre-stressed concrete (PC) tank including a foundation floor slab 2, an outer tank 3, a bottom portion cold reserving layer 4 (support portion), an inner tank 5 (reservoir), and a side portion cold reserving layer 6. In FIG. 1, a blanket 7, a pearlite 8, a thermal corner protection 9, and a lean concrete 10 are omitted and will be described below.

The foundation floor slab 2 is a foundation for supporting the outer tank 3, the inner tank 5, and the like from below. The foundation floor slab 2 is formed in a substantial disk shape having a diameter greater than that of the outer tank 3 when seen from above in a vertical direction. In this foundation floor slab 2, a heater (not shown) is installed to prevent cold energy of stored LNG from being transferred into the ground. The outer tank 3 is a container formed of pre-stressed concrete. The outer tank 3 stands on the foundation floor slab 2 such that the inner tank 5 is covered. This outer tank 3 includes a cylindrically shaped outer tank side wall 3*a*, and an outer tank ceiling portion 3*b* connected to an upper edge portion of the outer tank side wall 3*a*.

The inner tank 5 is a cylindrical metal container installed on the bottom portion cold reserving layer 4 and includes an opening portion and a bottom portion. LNG is stored inside the inner tank 5. Specifically, the inner tank 5 includes an inner tank bottom portion 5*a* (bottom portion), an inner tank side wall 5*b* (side wall) standing at an edge portion of the inner tank bottom portion 5*a*, and a ceiling 5*d* covering the opening portion of the inner tank 5. The ceiling 5*d* is suspended from the outer tank ceiling portion 3*b* to be supported.

The side portion cold reserving layer 6 is disposed between the outer tank side wall 3*a* and the inner tank side wall 5*b* and is formed by being filled with granular pearlite. In addition, as shown in FIG. 1, the side portion cold reserving layer 6 is formed to reach an upper portion of the inner tank 5. The side portion cold reserving layer 6 fill the sides of retaining walls (not illustrated) formed at an upper portion of the ceiling 5*d* and is disposed in an upper portion of an outer circumferential portion of the ceiling 5*d*.

The bottom portion cold reserving layer 4 is mounted on the upper surface of the foundation floor slab 2 and supports the inner tank 5 from below. This bottom portion cold reserving layer 4 is formed in a substantial disk shape having a diameter smaller than that of the foundation floor slab 2 and is disposed coaxially with the foundation floor slab 2 when seen from above in the vertical direction. This bottom portion cold reserving layer 4 includes an outer support portion 4*b* and an inner support portion 4*a*. The inner support portion 4*a* is surrounded by the outer support portion 4*b* when seen from above in the vertical direction.

The outer support portion 4*b* supports the edge portion of the inner tank 5 including the inner tank side wall 5*b* of the inner tank 5. The outer support portion 4*b* is formed of pearlite concrete.

The inner support portion 4*a* supports the inner tank bottom portion 5*a* of the inner tank 5 and is disposed to be adjacent to an inner side of the outer support portion 4*b*. The inner support portion 4*a* includes a heat insulating layer formed of an elastic material.

Figure 2:
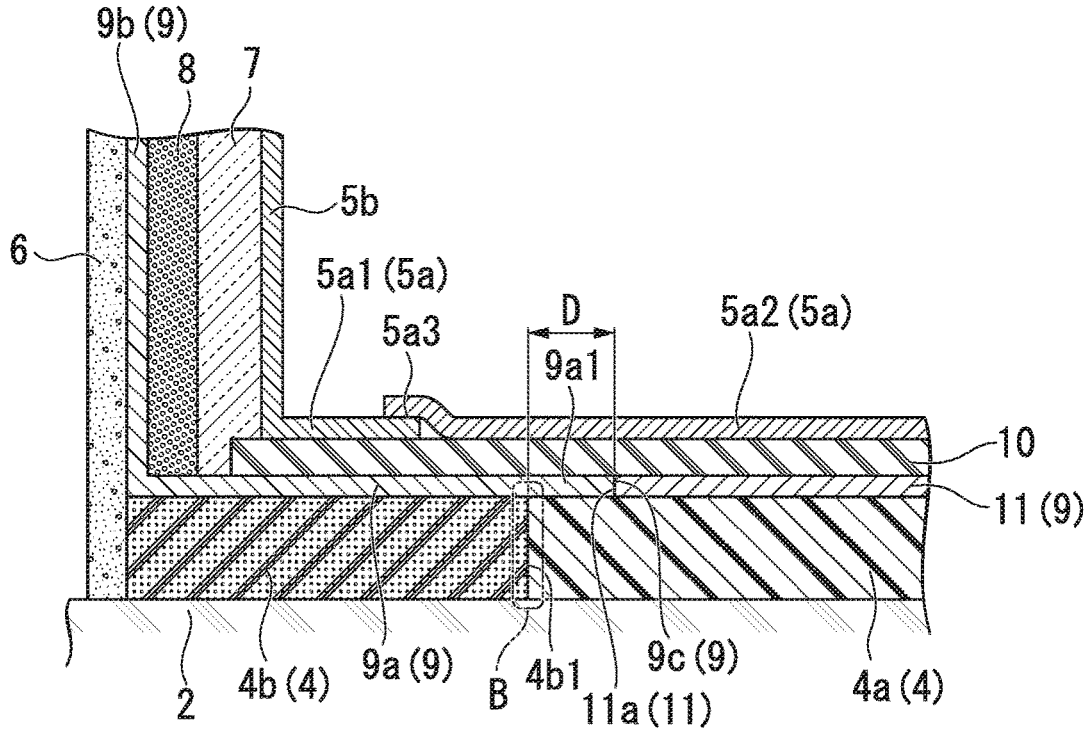
FIG. 2 is a sectional view showing an outer circumferential portion of a bottom portion cold reserving layer included in the cryogenic liquid tank according to the embodiment of the present disclosure and is an enlarged sectional view showing a part indicated with a reference sign P in FIG. 1.

FIG. 2 is an enlarged view in which a part indicated with a reference sign P in FIG. 1 is enlarged. In FIG. 2, in order to emphasize the difference between heights of the members, the height of each member is particularly changed and is shown compared to the actual dimensions.

As shown in FIG. 2, the blanket 7 covering the inner tank 5 is disposed on an outer side (in the radially outward direction) of the inner tank side wall 5*b*. The blanket 7 has a cold reserving function and absorbs thermal deformation of the inner tank 5. The pearlite 8 covering the blanket 7 is disposed on an outer side (in the radially outward direction) of the blanket 7. For example, the pearlite 8 is a foam body such as a porous material. A thermal corner wall plate 9*b* (thermal corner protection plate) constituting the thermal corner protection 9 is disposed on an outer side (in the radially outward direction) of the pearlite 8. The side portion cold reserving layer 6 described above is disposed on an outer side (in the radially outward direction) of the thermal corner wall plate 9*b*.

The thermal corner protection 9 includes the thermal corner wall plate 9*b* extending in the vertical direction and an annular plate 9*a* (thermal corner protection plate) extending in the horizontal direction and having a thickness of 8 mm. The thermal corner protection 9 is formed in an L-shape in a sectional view. The annular plate 9*a* is connected to a lower end of the thermal corner wall plate 9*b* formed between the pearlite 8 and the side portion cold reserving layer 6.

The bottom portion cold reserving layer 4 is constituted of the outer support portion 4*b* (outer circumferential portion) disposed below the inner tank side wall 5*b* of the inner tank 5, and the inner support portion 4*a* (central portion) disposed on the inner side of the outer support portion 4*b*.

The outer support portion 4*b* is provided below the annular plate 9*a* and supports the annular plate 9*a*. The outer support portion 4*b* is provided annularly along the inner tank side wall 5*b* of the inner tank 5 (in the circumferential direction of the cryogenic liquid tank 1).

The inner support portion 4*a* is installed on the foundation floor slab 2 and includes a heat insulating layer. The heat insulating layer included in the inner support portion 4*a* is formed of rigid polyurethane foam and prevents heat from entering the inner tank 5 from the ground surface.

A thermal corner bottom plate 11 (thermal corner protection plate) constituting the thermal corner protection 9 is provided on the inner support portion 4*a*. FIG. 2 shows a structure in which only one thermal corner bottom plate 11 is provided on the inner support portion 4*a* on the inner side of the annular plate 9*a* having an annular shape. However, a plurality of thermal corner bottom plates 11 are disposed on the upper surface of the inner support portion 4*a*. The thermal corner bottom plates 11 are provided to be adjacent to the annular plate 9*a*. The positions of outer end surfaces 11*a* of the thermal corner bottom plates 11 and the position of an inner end surface 9*c* (an inner end surface of an extending portion 9*a*1 (which will be described below)) of the annular plate 9*a* are the same as each other.

The lean concrete 10 is disposed on the upper surface of the annular plate 9*a* and the upper surfaces of the thermal corner bottom plates 11 to cover the inner end surface 9*c* and the outer end surfaces 11*a*. The lean concrete 10 is provided between the inner tank 5 and the bottom portion cold reserving layer 4 (the outer support portion 4*b* and the inner support portion 4*a*) and is an example of an "intermediate member". The lean concrete 10 overlaps a boundary B between the outer support portion 4*b* and the inner support portion 4*a* when seen from above in the vertical direction.

An outer bottom plate 5*a*1 (bottom portion) and an inner bottom plate 5*a*2 (bottom portion) which form the inner tank bottom portion 5*a* are disposed on the upper surface of the lean concrete 10. The outer bottom plate 5*a*1 is connected to the inner tank side wall 5*b* and forms an L-shaped member in a sectional view. The outer bottom plate 5*a*1 and the inner bottom plate 5*a*2 are joined to each other through welding or the like at a joint portion 5*a*3 and are supported by a support surface (upper surface) of the lean concrete 10.

FIG. 2 shows a structure in which only one inner bottom plate 5*a*2 is provided on the lean concrete 10 on the inner side of the annular outer bottom plate 5*a*1. However, a plurality of inner bottom plates 5*a*2 are disposed on the upper surface of the lean concrete 10, and adjacent inner bottom plates 5*a*2 are joined to each other through welding or the like.

For example, the material of the outer bottom plate 5*a*1 and the inner bottom plates 5*a*2 is nickel steel.

A specific structure of the annular plate 9*a* will be described.

The annular plate 9*a* includes the extending portion 9*a*1. The extending portion 9*a*1 is provided on the outer support portion 4*b* (the upper surface of the outer support portion 4*b*) and on the inner support portion 4*a* (the upper surface of the inner support portion 4*a*) and extends from the outer support portion 4*b* toward the inner support portion 4*a*.

The annular plate 9*a* including the extending portion 9*a*1 is an example of a "cover portion".

The extending portion 9*a*1 is integrally formed with the annular plate 9*a*. The extending portion 9*a*1 is provided on the inner support portion 4*a* and covers the boundary B between the outer support portion 4*b* and the inner support portion 4*a* when seen from above in the vertical direction.

A distance D from an end portion 4*b*1 of the outer support portion 4*b* to the inner end surface 9*c* of the extending portion 9*a*1 is adequately set in accordance with the construction cost of the cryogenic liquid tank 1. For example, the upper limit for the distance D is 500 mm. If the distance D exceeds 500 mm, the construction cost will increase, which is not preferable.

An extending pattern (plane shape, plane pattern) of the extending portion 9*a*1 seen from above in the vertical direction covers an outer end (a position coincides with the boundary B) of the inner support portion 4*a* and has a substantially circular shape.

In the plane pattern of the extending portion 9*a*1, partially protruding portions protruding in the radially inward direction may be provided at an equal angular pitch. In other words, the distance D is not necessarily a constant value, and the distance D of the extending portion in which the partially protruding portions are provided may be greater than the distance D of the extending portion in which the partially protruding portions are not provided.

In the cryogenic liquid tank 1 according to the present embodiment, since LNG is stored inside the inner tank 5, liquid pressure is applied to the inner tank 5 while the cryogenic liquid tank 1 is in operation. Particularly, if liquid pressure is added to the inner tank bottom portion 5*a* of the inner tank 5, a load corresponding to the liquid pressure is applied to the lean concrete 10 positioned below the inner tank bottom portion 5*a*. Moreover, a load added to the lean concrete 10 is applied to the annular plate 9*a* and the thermal corner bottom plates 11 positioned below the lean concrete 10. Moreover, a load applied to the annular plate 9*a* and the thermal corner bottom plates 11 is added to the bottom portion cold reserving layer 4. Since the heat insulating layer included in the inner support portion 4*a* constituting the bottom portion cold reserving layer 4 is formed of rigid polyurethane foam which is an elastic material, the inner support portion 4*a* is precipitated due to a load corresponding to the liquid pressure of LNG. Moreover, rigid polyurethane foam is gradually precipitated (creep deformation) with time due to the cryogenic liquid tank 1 which has been used over a long period of time. Specifically, there are cases where the inner support portion 4*a* is relatively settled down approximately 10 mm to 20 mm with respect to the outer support portion 4*b* and a step part is generated in the boundary B.

Particularly, as in the related art, in a case of a structure in which lean concrete is in direct contact with a step part, the lean concrete is locally deformed due to the step part. Particularly, at a site in which lean concrete and a step part are in contact with each other, the lean concrete is rapidly bent and is deformed. In response to deformation of the lean concrete, an inner tank bottom portion positioned on the lean concrete is locally deformed.

In contrast, in the cryogenic liquid tank 1 according to the present embodiment, the annular plate 9*a* (cover portion) covers the boundary B between the outer support portion 4*b* and the inner support portion 4*a*. Therefore, even if the step part described above is generated in the boundary B, the annular plate 9*a* including the extending portion 9*a*1 covers the step part, the lean concrete 10 is restrained from being rapidly and locally deformed, and the lean concrete 10 is gently deformed. Since local deformation of the lean concrete 10 is restrained, the inner tank bottom portion 5*a* positioned on the lean concrete 10 is prevented from being locally deformed. Accordingly, local bending stress caused by the generated step part can be prevented from being applied to the inner tank bottom portion 5*a*. Therefore, according to the present embodiment, in the cryogenic liquid tank 1 including the bottom portion cold reserving layer 4 supporting the inner tank 5, it is possible to prevent a significant load from being applied to the inner tank bottom portion 5*a* of the inner tank 5 while being in use.

In addition, the annular plate 9*a* covers the boundary B between the outer support portion 4*b* and the inner support portion 4*a*. Therefore, even if a step part is generated in the boundary B between the outer support portion 4*b* and the inner support portion 4*a*, the annular plate 9*a* including the extending portion 9*a*1 covers the step part, so that the thermal corner bottom plates 11 and the step part can be prevented from coming into contact with each other. Accordingly, bending stress caused by such contact can be prevented from being applied to the thermal corner bottom plates 11.

In addition, in the cryogenic liquid tank 1 according to the present embodiment, since the annular plate 9*a* covers the boundary B, there is no need to dispose a separate member different from the annular plate 9*a* in the boundary B, and the number of components constituting the cryogenic liquid tank 1 can be reduced.

Figure 3:
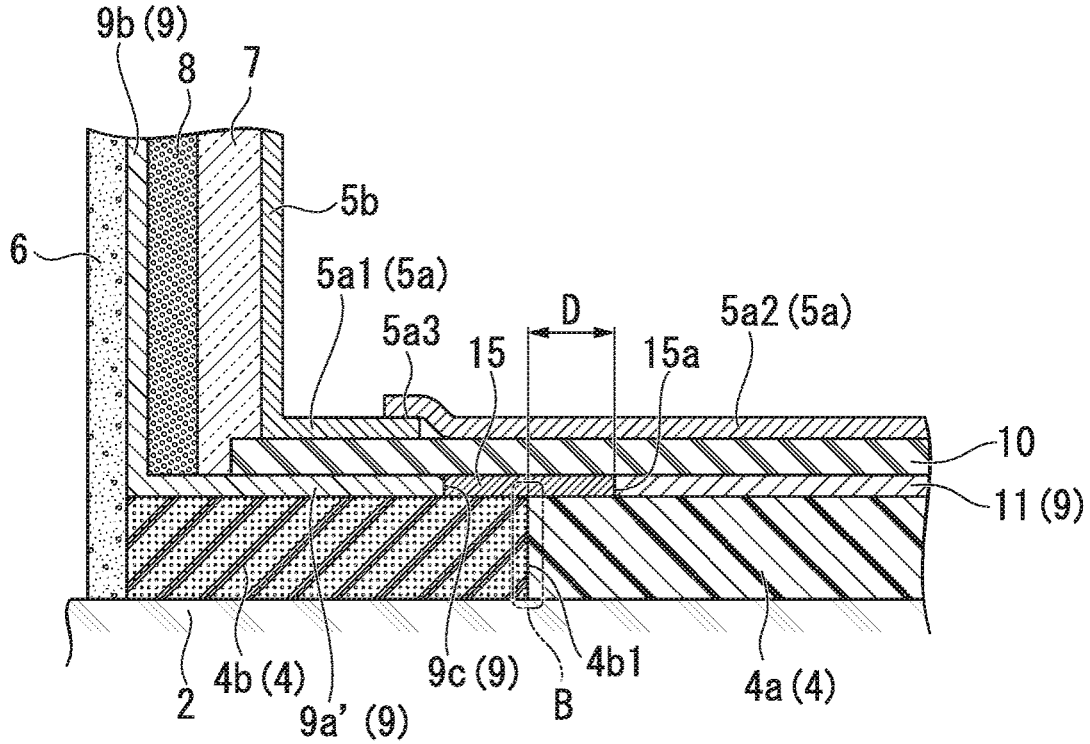
FIG. 3 is a sectional view showing the outer circumferential portion of the bottom portion cold reserving layer included in a cryogenic liquid tank according to Deformation Example 1 of the embodiment of the present disclosure, and is an enlarged sectional view showing a part indicated with the reference sign P in FIG. 1.

FIG. 3 is a sectional view showing the outer circumferential portion of the bottom portion cold reserving layer included in a cryogenic liquid tank according to Deformation Example 1 of the embodiment of the present disclosure, and is an enlarged sectional view showing a part indicated with the reference sign P in FIG. 1.

In FIG. 3, the same reference signs are applied to the same members as those in the embodiment described above and description thereof is omitted or simplified.

The present Deformation Example 1 differs from the embodiment described above in that the cryogenic liquid tank 1 includes a cover plate which is a member separated from an annular plate 9*a'*.

As shown in FIG. 3, a cover plate 15 is provided to be adjacent to the inner side of the annular plate 9*a*' disposed on the outer support portion 4*b* and is a member separated from the annular plate 9*a'*.

The length of the annular plate 9*a*' in the radial direction of the cryogenic liquid tank 1 shown in FIG. 3 is shorter than the length of the annular plate 9*a* shown in FIG. 1, and the cover plate 15 is disposed to abut on the inner end surface 9*c* of the annular plate 9*a*'. The cover plate 15 may be connected to the annular plate 9*a*' through welding or the like. The cover plate 15 is an example of a "cover portion".

Specifically, the cover plate 15 is provided on the outer support portion 4*b* and on the inner support portion 4*a*, extends in a direction from the outer support portion 4*b* toward the inner support portion 4*a*, and covers the boundary B between the outer support portion 4*b* and the inner support portion 4*a* when seen from above in the vertical direction.

The lean concrete 10 is disposed on the upper surface of the annular plate 9*a*', the upper surface of the cover plate 15, and the upper surface of the thermal corner bottom plates 11 to cover the inner end surface 9*c* and an inner end surface 15*a*.

The distance D from the end portion 4*b*1 of the outer support portion 4*b* to the inner end surface 15*a* of the cover plate 15 is similar to that of the embodiment described above. For example, the plane pattern of the cover plate 15 may be a pattern similar to that of the extending portion 9*a*1 described above.

In the present Deformation Example 1, the cover plate 15 covers the boundary B between the outer support portion 4*b* and the inner support portion 4*a*. Therefore, even if the step part described above is generated in the boundary B, since the cover plate 15 covers the step part, the lean concrete 10 is restrained from being rapidly and locally deformed, so that the lean concrete 10 is gently deformed. Since local deformation of the lean concrete 10 is restrained, the inner tank bottom portion 5*a* positioned on the lean concrete 10 is prevented from being locally deformed. Accordingly, local bending stress caused by the generated step part can be prevented from being applied to the inner tank bottom portion 5*a*. Therefore, according to the present deformation example, in the cryogenic liquid tank 1 including the bottom portion cold reserving layer 4 supporting the inner tank 5, it is possible to prevent a significant load from being applied to the inner tank bottom portion 5*a* of the inner tank 5 while being in use.

In addition, the cover plate 15 covers the boundary B between the outer support portion 4*b* and the inner support portion 4*a*. Therefore, even if a step part is generated in the boundary B between the outer support portion 4*b* and the inner support portion 4*a*, the cover plate 15 covers the step part, so that the thermal corner bottom plates 11 and the step part can be prevented from coming into contact with each other. Accordingly, bending stress caused by such contact can be prevented from being applied to the thermal corner bottom plates 11.

Figure 4:
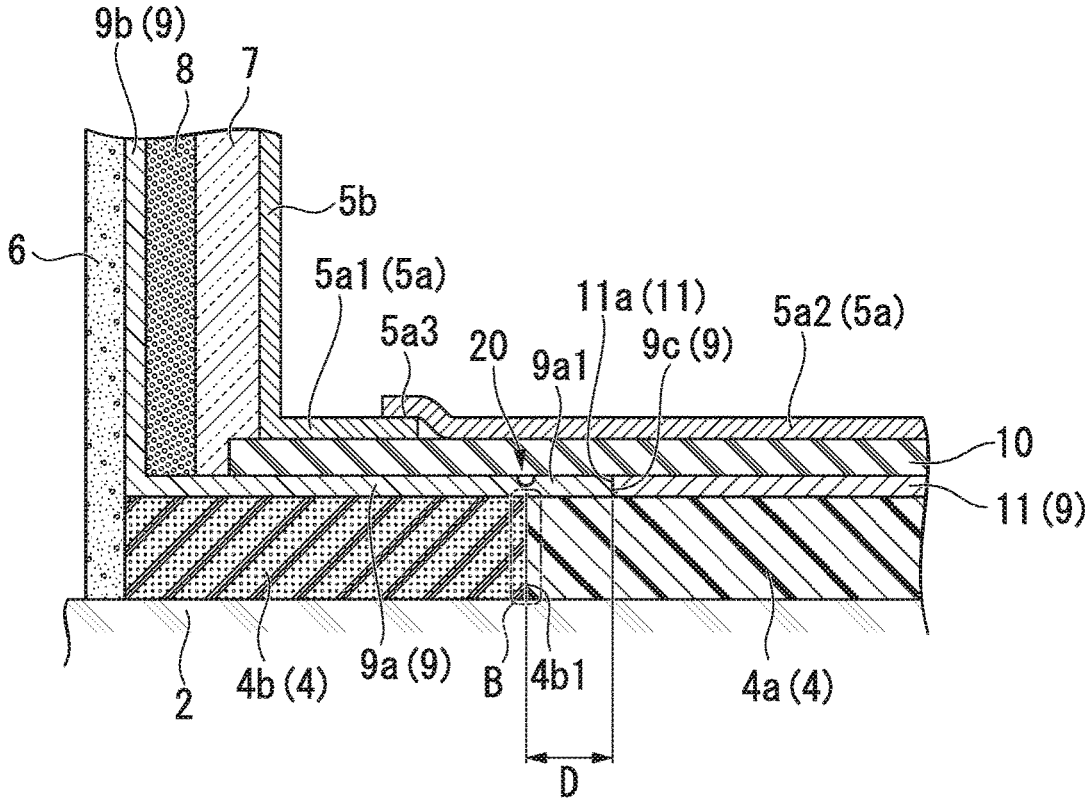
FIG. 4 is a sectional view showing the outer circumferential portion of the bottom portion cold reserving layer included in a cryogenic liquid tank according to Deformation Example 2 of the embodiment of the present disclosure, and is an enlarged sectional view showing a part indicated with the reference sign P in FIG. 1.

FIG. 4 is a sectional view showing the outer circumferential portion of the bottom portion cold reserving layer included in a cryogenic liquid tank according to Deformation Example 2 of the embodiment of the present disclosure, and is an enlarged sectional view showing a part indicated with the reference sign P in FIG. 1.

In FIG. 4, the same reference signs are applied to the same members as those in the embodiment described above and a description thereof is omitted or simplified.

The present Deformation Example 2 differs from the embodiment described above in that the annular plate 9*a* includes a recess portion 20.

Specifically, as shown in FIG. 4, the recess portion 20 is provided at a position overlapping the boundary B between the outer support portion 4*b* and the inner support portion 4*a*. The extending portion 9*a*1 extends to protrude from the end portion 4*b*1 of the outer support portion 4*b* toward the inner end surface 9*c* of the annular plate 9*a* from the recess portion 20. In other words, the recess portion 20 is provided in a root portion of the extending portion 9*a*1.

In the present Deformation Example 2, the inner support portion 4*a* is precipitated due to liquid pressure added to the inner tank bottom portion 5*a* of the inner tank 5, or rigid polyurethane foam constituting the inner support portion 4*a* is gradually precipitated with time due to the cryogenic liquid tank 1 which has been used over a long period of time. Therefore, the inner tank bottom portion 5*a* is pressed down, and a step part is generated in the boundary B between the outer support portion 4*b* and the inner support portion 4*a*. As a result of the generated step part, a load is also applied to the extending portion 9*a*1. Since the annular plate 9*a* includes the recess portion 20 provided at a position corresponding to the boundary B, a load is applied to the annular plate 9*a*, so that the annular plate 9*a* is likely to be deformed in the recess portion 20. Therefore, if a load is added to the annular plate 9*a* such that the inner tank bottom portion 5*a* is pressed down, the annular plate 9*a* is deformed in the recess portion 20 such that a portion of the annular plate 9*a* from the recess portion 20 to the inner end surface 9*c* is directed obliquely downward (that is, directed toward the inner support portion 4*a*).

Therefore, according to the present Deformation Example 2, it is possible to not only achieve effects similar to those of the embodiment described above but also cause the annular plate 9*a* to be deformed in accordance with a load applied to the inner tank bottom portion 5*a*, so that the lean concrete 10 can be restrained from being locally deformed. It is possible to relax stress generated in the joint portion 5*a*3 provided between the outer bottom plate 5*a*1 and the inner bottom plates 5*a*2, or stress generated in the inner tank bottom portion 5*a* in a dispersive manner.

Figure 5:
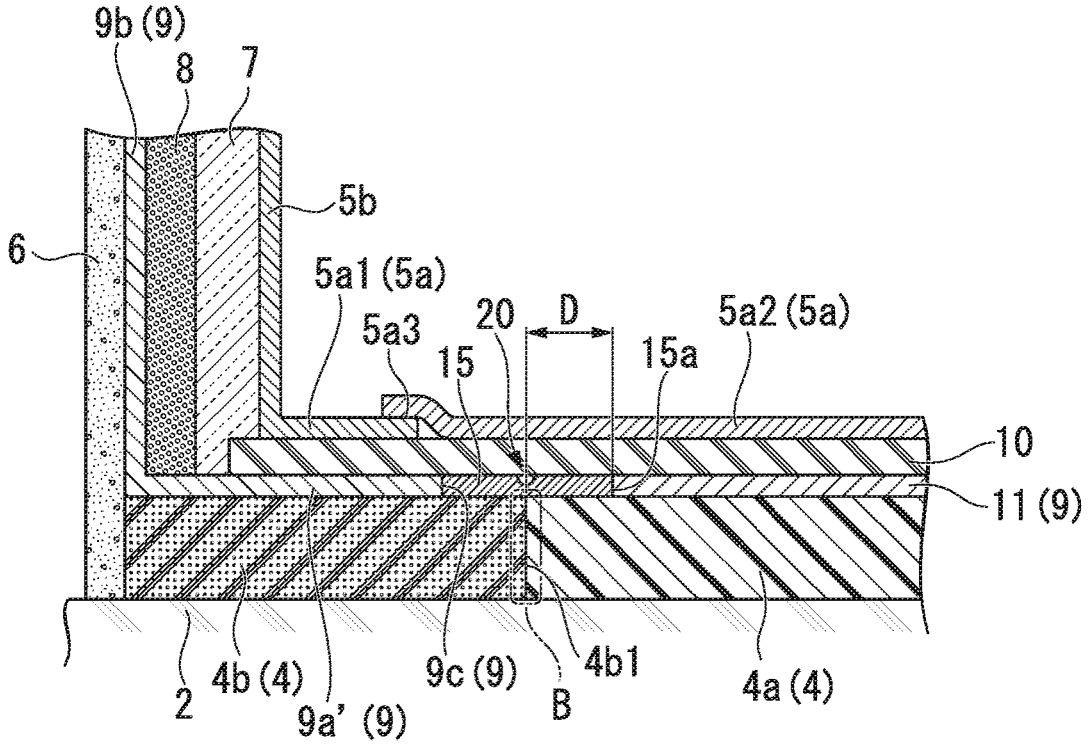
FIG. 5 is another sectional view showing the outer circumferential portion of the bottom portion cold reserving layer included in the cryogenic liquid tank according to Deformation Example 2 of the embodiment of the present disclosure, and is an enlarged sectional view showing a part indicated with the reference sign P in FIG. 1.

The recess portion 20 described in the present Deformation Example 2 may also be applied to Deformation Example 1 described above. Specifically, as illustrated in FIG. 5, in a configuration in which the cover plate 15 is provided at a position overlapping the boundary B, the recess portion 20 may be formed in the cover plate 15 at a position overlapping the boundary B. Even in this case as well, it is possible to achieve the effects described above.

Hereinabove, the embodiment and the deformation examples of the present disclosure have been described with reference to the drawings. However, the present disclosure is not limited to the embodiment. All of the shapes, the combinations, and the like of the constituent members shown in the embodiment described above are merely examples, and various changes can be made based on design requirements and the like within a range not departing from the scope of the present disclosure.

INDUSTRIAL APPLICABILITY

According to a cryogenic liquid tank including a support portion supporting a reservoir of the present disclosure, it is possible to prevent a significant load from being applied to a bottom portion of the reservoir while being in use.

REFERENCE SIGNS LIST

1 cryogenic liquid tank
2 foundation floor slab
3 outer tank
3*a* outer tank side wall
3*b* outer tank ceiling portion
4 bottom portion cold reserving layer (support portion)
4*b*1 end portion
4*b* outer support portion (outer circumferential portion)
4*a* inner support portion (central portion)
5 inner tank (reservoir)
5*a* inner tank bottom portion (bottom portion)
5*a*1 outer bottom plate (bottom portion)
5*a*2 inner bottom plates (bottom portion)
5*a*3 joint portion
5*b* inner tank side wall (side wall)
5*d* ceiling
6 side portion cold reserving layer
7 blanket
8 pearlite
9 thermal corner protection
9*a* annular plate (cover portion)
9*b* thermal corner wall plate
9*c* inner end surface
9*a*' annular plate
9*a*1 extending portion (cover portion)
10 lean concrete
11 thermal corner bottom plate
11*a* outer end surface
15 cover plate (cover portion)
15*a* inner end surface
20 recess portion
B boundary
D distance

The invention claimed is:

1. A cryogenic liquid tank comprising:

a reservoir that includes a bottom portion and a side wall;

a support portion that supports the reservoir; and an intermediate member that is provided between the reservoir and the support portion, wherein the support portion includes an outer support portion which supports the side wall, and an inner support portion which is disposed to be adjacent to an inner side of the outer support portion, includes a heat insulating layer formed of an elastic material, and supports the bottom portion of the reservoir, wherein a cover portion covering a boundary between the outer support portion and the inner support portion is provided between the support portion and the intermediate member, wherein an annular plate is disposed on the outer support portion, and wherein the cover portion is a cover plate which is provided to be adjacent to an inner side of the annular plate and is a member separated from the annular plate.

2. The cryogenic liquid tank according to claim 1, wherein the cover portion includes a recess portion provided at a position overlapping the boundary between the outer support portion and the inner support portion.

* * * * *